US008998560B2

(12) United States Patent
Crane et al.

(10) Patent No.: US 8,998,560 B2
(45) Date of Patent: Apr. 7, 2015

(54) BOOM ASSEMBLY

(75) Inventors: Jesse A. Crane, Dubuque, IA (US); David E. Lemm, East Dubuque, IA (US)

(73) Assignee: Deere & Company, Moline, IL (US)

( * ) Notice: Subject to any disclaimer, the term of this patent is extended or adjusted under 35 U.S.C. 154(b) by 646 days.

(21) Appl. No.: 13/344,074

(22) Filed: Jan. 5, 2012

(65) Prior Publication Data

US 2013/0177375 A1 Jul. 11, 2013

(51) Int. Cl.

| | |
|---|---|
| ***E02F 9/14*** | (2006.01) |
| ***E02F 3/38*** | (2006.01) |
| ***E02F 9/00*** | (2006.01) |

(52) U.S. Cl.

CPC ..... *E02F 9/006* (2013.01); *E02F 3/382* (2013.01)

(58) Field of Classification Search

CPC ..... E02F 9/006; E02F 3/382
USPC ..... 414/722, 727
See application file for complete search history.

(56) References Cited

U.S. PATENT DOCUMENTS

| | | | | |
|---|---|---|---|---|
| 3,094,229 | A * | 6/1963 | Johnson et al. | 414/694 |
| 4,798,512 | A | 1/1989 | Intveld | |
| 5,405,237 | A * | 4/1995 | Oka | 414/722 |
| 6,106,217 | A | 8/2000 | Knell | |
| 7,448,841 | B2 * | 11/2008 | Ishikawa et al. | 414/722 |
| 2004/0191043 | A1 * | 9/2004 | Davis et al. | 414/722 |
| 2006/0251349 | A1 * | 11/2006 | Schmeling et al. | 384/91 |
| 2008/0187427 | A1 * | 8/2008 | Durney | 414/722 |

* cited by examiner

*Primary Examiner* — Scott Lowe

(57) ABSTRACT

A boom assembly is provided for a material handling machine. The boom assembly includes a boom pivotally coupled to a frame of the machine. The boom has a pair of side plates, a top plate and a bottom plate that are rigidly interconnected. The top plates have a pair of slots which extend therethrough. An arm is pivotally coupled to an end of the boom. A mounting unit extends between a center portion of the side plates. A pair of hydraulic boom cylinders are coupled between the frame and the mounting unit. A pair of spaced apart arm cylinder mounting plates are rigidly mounted to the mounting unit. Each mounting plate extends through a corresponding one of the slots. An arm cylinder is connected between the mounting plates and an arm.

9 Claims, 6 Drawing Sheets

BOOM ASSEMBLY

FIELD OF THE INVENTION

The present disclosure relates to a boom assembly, such as for a work vehicle.

BACKGROUND OF THE INVENTION

Industrial loaders used in the construction and mining industries have a frame which carries a loader boom. The loader boom is conventionally raised and lowered by means of a pair of hydraulic cylinders having one end connected to the loader frame section and their piston rod ends connected to transversely spaced boom arms. The boom arms are normally rigidly interconnected by one or more transverse members. The boom lift cylinders transmit large forces to the boom arms.

One way of attaching the cylinder rods to the loader arms has been to provide a yoke on the end of the cylinder rod with a transverse pin extending through the yoke and a portion of the boom arm. In such a case, the cylinder is disposed in the same vertical plane as the loader arm, and a relatively large yoke is required to transmit the forces involved. Also, the single thickness of the boom arm absorbs the entire load.

If the cylinders are connected to the boom arm mounting plates, then the mounting plates have to be relatively large and the welds extensive to accommodate the forces involved. This results in an expensive and heavy boom. If a boom weighs too much, the hydraulic cylinder can have difficulty controlling the boom during operation.

U.S. Pat. No. 4,798,512 shows a loader boom that is controlled by a pair of hydraulic cylinders acting between the main frame of the loader and a pair of parallel, transversely spaced boom arms that are interconnected by a transverse tube. A pair of tabs are respectively welded to the tube a short distance from the opposite ends of the tube, and the piston ends of the cylinders are respectively connected to the boom arms by a transverse pin extending through aligned bores in the tabs, eye members attached to the ends of the hydraulic cylinder piston rods, and the boom arms. However, in this design the boom is coupled directly to a bucket and both the boom and bucket cylinders are coupled to a vehicle frame part.

SUMMARY

According to an aspect of the present disclosure, a lower cost boom assembly is provided.

According to an aspect of the present disclosure, a lighter weight boom assembly is provided.

The boom assembly includes a boom pivotally coupled to a frame of the machine. The boom has a pair of transversely spaced boom side plates, a top plate and a bottom plate that are rigidly interconnected. The top plate has a pair of slots spaced apart from each other. An arm is pivotally coupled to an end of the boom. A transverse mounting unit extends between a center portion of the side plates. A pair of hydraulic boom cylinders are coupled to the boom. Each boom cylinder has a first end coupled to the frame and a second end coupled to a respective end of the mounting unit. A pair of arm cylinder mounting plates are rigidly mounted to the mounting unit. The mounting plates are spaced apart from each other and project away from the mounting unit. Each mounting plate extends through a corresponding one of the slots, and an hydraulic arm cylinder has a first end coupled to the mounting plates and has a second end coupled to the arm.

DETAILED DESCRIPTION OF THE DRAWINGS

Figure 1:
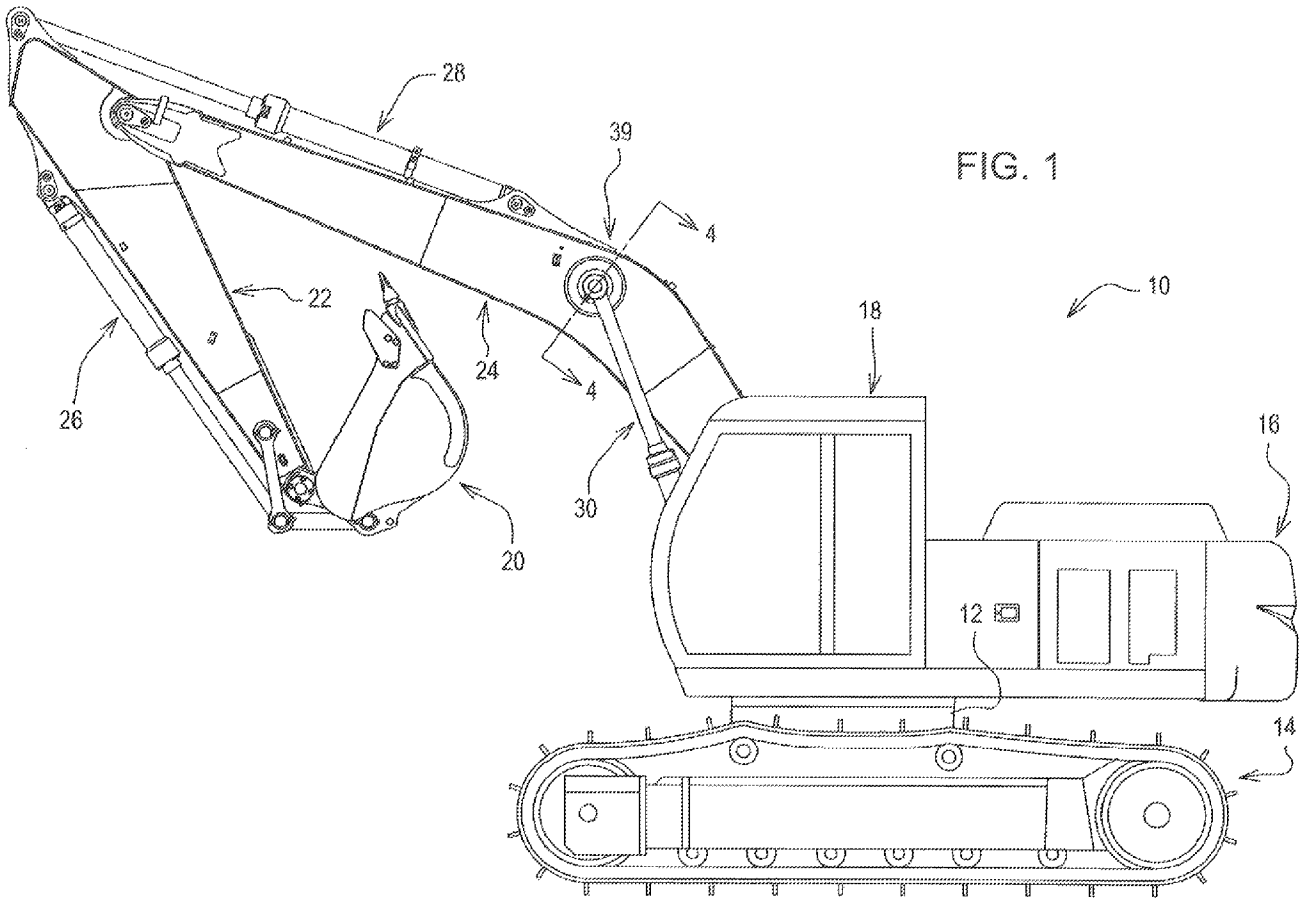
FIG. 1 is a side view of a work vehicle with a boom embodying the invention.
Figure 2:
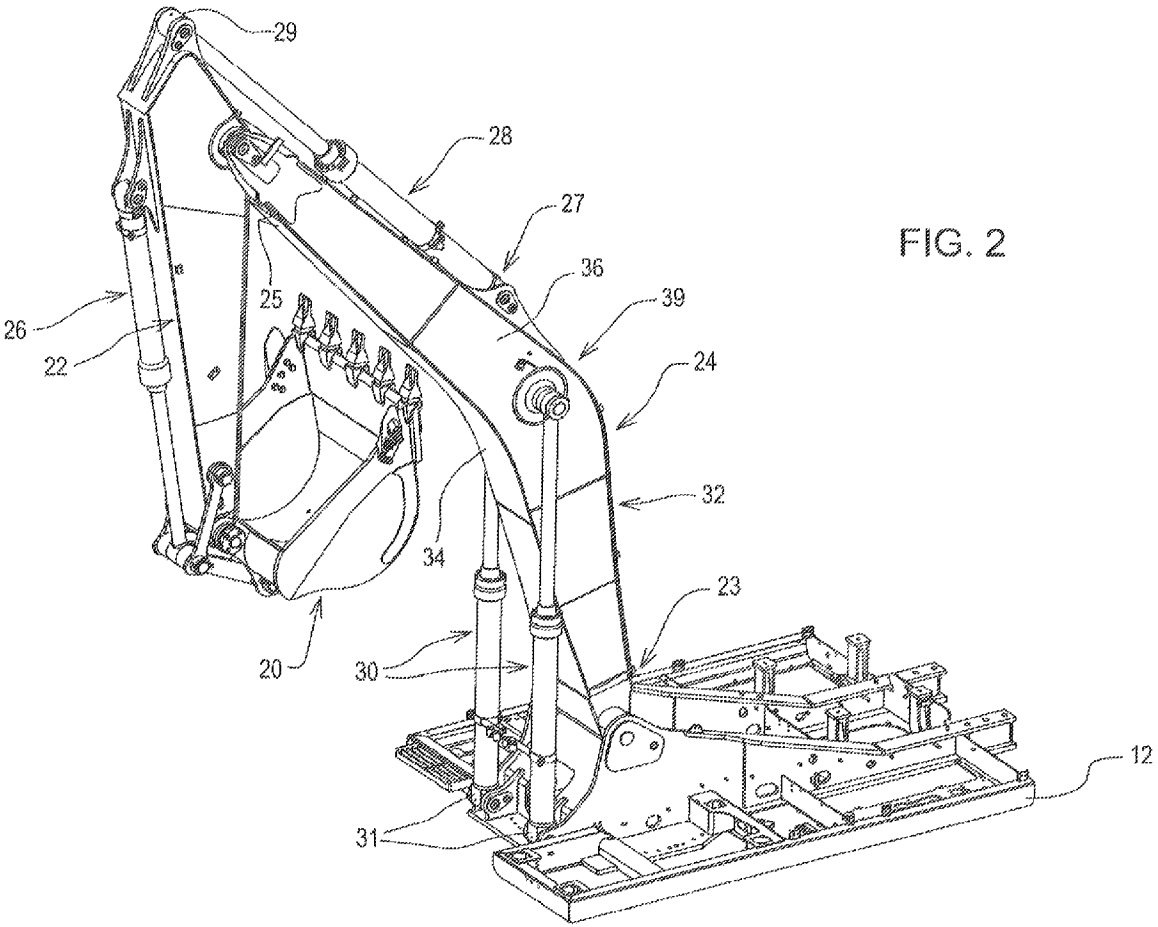
FIG. 2 is a perspective view of a boom assembly with a boom embodying the invention.

Referring to FIGS. 1 and 2, a work vehicle 10, such as an excavator, can be equipped with a boom for doing excavation and other heavy-duty work. The work vehicle 10 includes a base or undercarriage 12 to which a ground engaging assembly 14 is provided for supporting and propelling the vehicle 10. The ground engaging assembly 14 can include tracks, as shown, or alternatively may include tires. The vehicle 10 is provided with a supporting structure 16 which is disposed upon the base 12. A cab 18 is disposed adjacent to the support structure 16 and can include control levers, joysticks, and other assemblies for controlling the movement and operation of the vehicle 10.

The work vehicle can also include a work attachment, such as a bucket 20, for performing a working operation. The bucket 20 is pivotally mounted to one end of an arm 22 which in turn is pivotally mounted to a boom 24. A bucket hydraulic cylinder 26 is used for pivoting the bucket 20 relative to the arm 22. Similarly, an arm hydraulic cylinder 28 is provided for pivoting the arm 22 relative to the boom 24. A pair of boom hydraulic cylinders 30 are is provided for pivoting the boom 24 relative to the supporting structure 16. The supporting structure 16 can be pivoted relative to the base 12 by a hydraulic motor (not shown).

The boom 24 is an elongated body that is loaded at both ends thereof during operation and is also heavily loaded at cylinder attachment points. The boom 24 has a top plate 32, a bottom plate 34, a left side plate 36 and a right side plate 38 (seen in FIG. 3).

Figure 3:
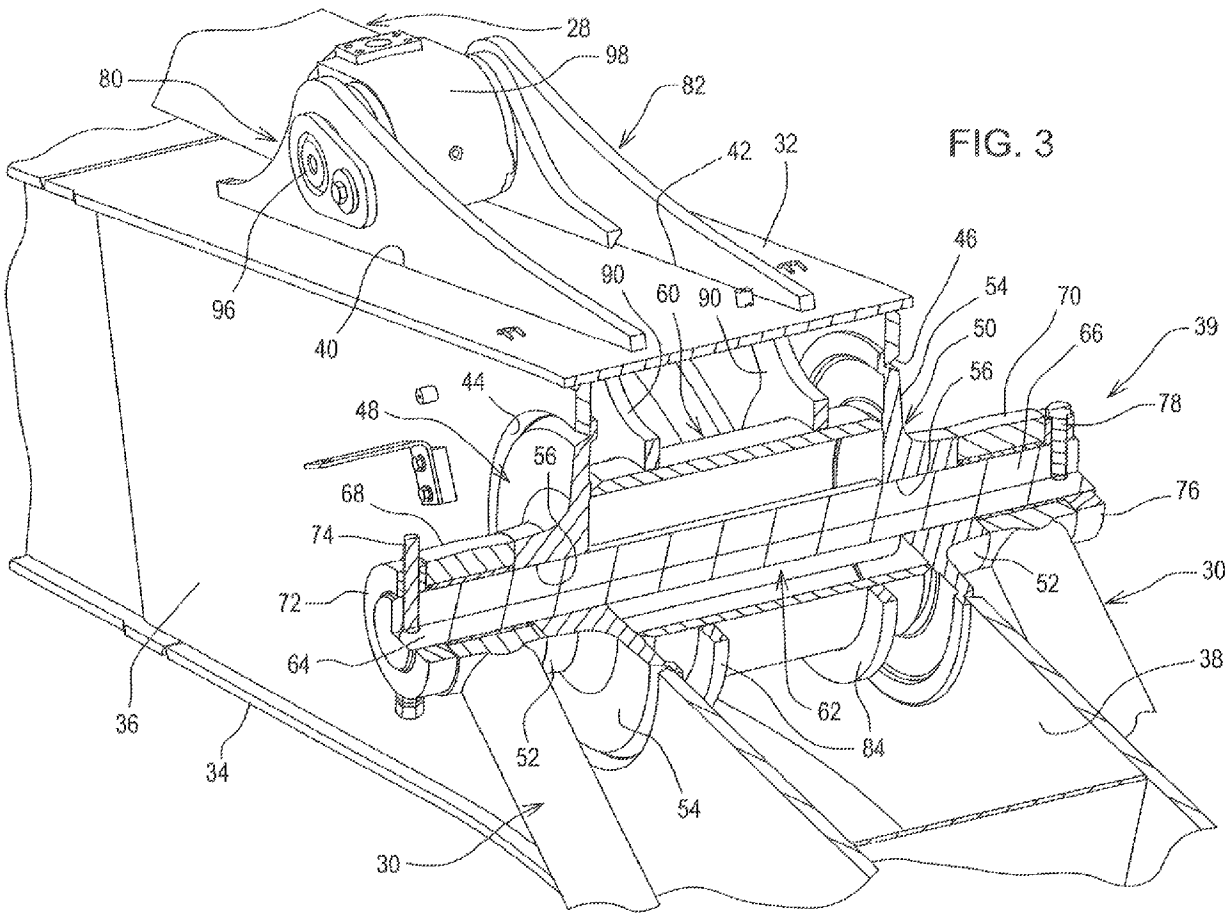
FIG. 3 is a perspective sectional view of a center portion of the boom of FIG. 2 with portions removed.
Figure 4:
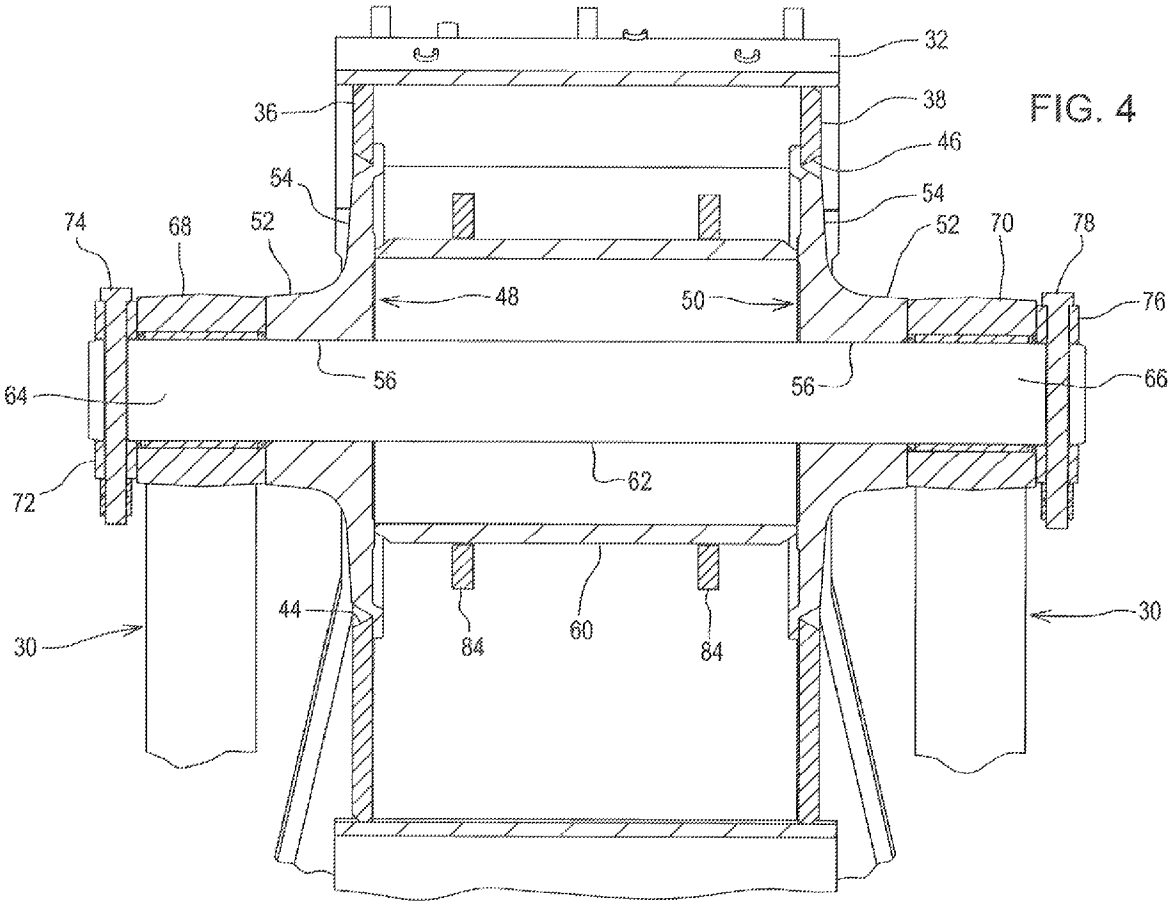
FIG. 4 is a sectional view along lines 4-4 of FIG. 2.
Figure 5:
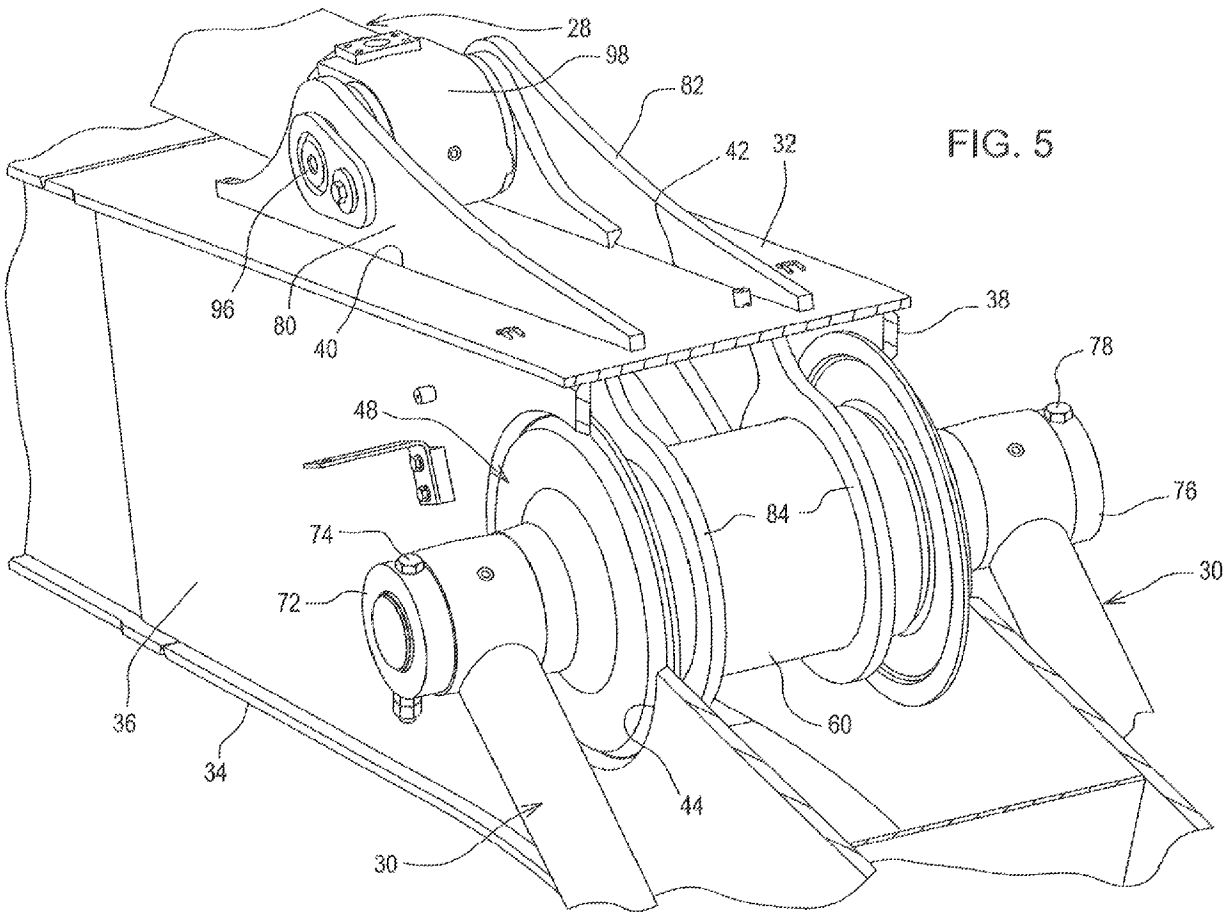
FIG. 5 is a perspective partially sectioned view of the center portion of the boom of FIG. 2 with portions removed.
Figure 6:
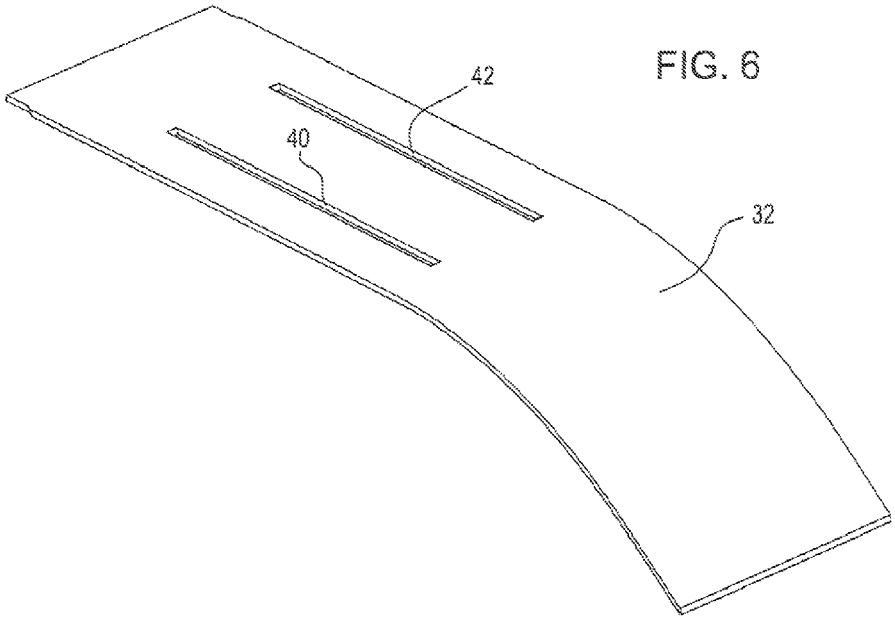
FIG. 6 is a perspective view of a center portion of the top plate of the boom of FIG. 2.

As best seen in FIGS. 3 and 6, a pair of slots 40 and 42 are formed in a central portion of the top plate 32. The slots 40 and 42 are laterally spaced apart, extend parallel to each other and to the side plates 36 and 38, and extend through the top plate 32 from it bottom surface to its top surface. Left and right circular openings 44 and 46 are formed in the left and right side plates 36 and 38, respectively.

Referring now to FIGS. 3-7, the boom 24 includes a mounting unit 39 which is mounted to a central portion of the boom 24. The mounting unit 39 includes left and right hubs 48 and 50 are fixedly mounted in the respective openings 44 and 46. Each hub 48 and 50 includes a hollow shaft 52 and a circular flange 54 which projects radially outwardly from an inner end thereof, and a central cylindrical bore 56. A hollow transverse tube or cross tube 60 has opposite ends, fixed, such as by welding to the inwardly facing sides of the hubs 48 and 50. A shaft 62 is received by the hubs 48 and 50 and has left and right ends 64 and 66 which project outwardly from the hubs. Left end 64 of shaft 62 is received by an eye 68 of left boom cylinder 30. Right end 66 of shaft 62 is received by an eye 70 of right boom cylinder 30. The flanges 54 are preferably are welded in a subassembly with the center tube 60 and the arm cylinder plates 80 and 82. The hubs 48 are then welded to the side plates 36 and 38.

Outwardly of eye 68, the left end 64 of shaft 62 is received by a retainer ring 72 which is non-rotatably coupled to shaft 62 by a pin 74. Outwardly of eye 70, the right end 66 of shaft 62 is received by a retainer ring 76 which is non-rotatably coupled to shaft 62 by a pin 78.

Figure 7:
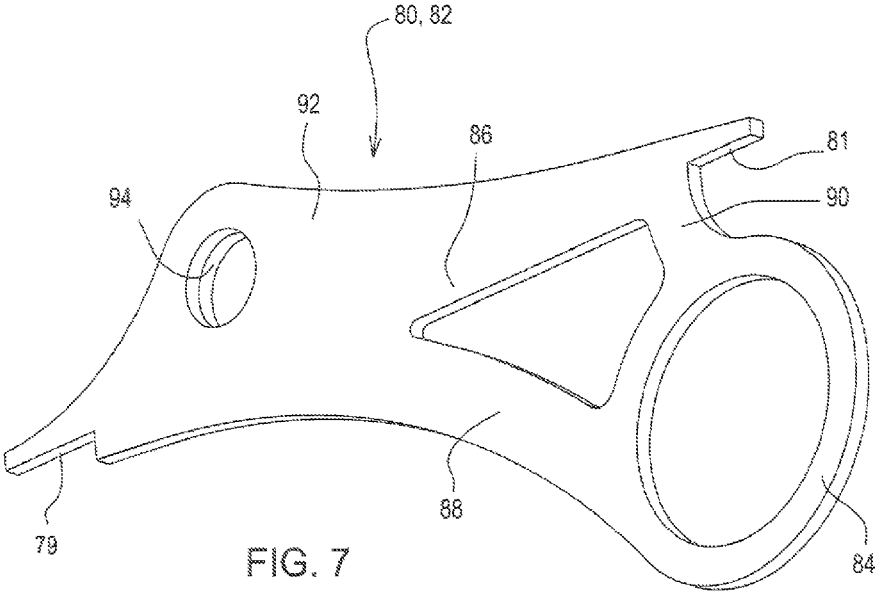
FIG. 7 is a perspective view of the supports of FIGS. 3-5.

A pair of supports or boom cylinder mounting plates 80 and 82 are rigidly mounted to the tube 60 and spaced apart from each other. Referring now to FIG. 7, each mounting plate 80 and 82 includes a hollow cylindrical ring 84 which is rigidly attached to the cross tube 60, a base 86 which is received by a corresponding one of the slots 40 and 42. Each mounting plate 80 and 82 also includes a pair of spaced apart support arms 88 and 90 which attach the base 86 to the ring 84, and a support bracket 92 connected to the base. A bore 94 is formed near an outer end of the bracket 92. Preferably, each mounting plate 80 and 82 is a one-piece integral structure. The bores 94 receive a cross pin 96 which is pivotally coupled to an eye 98 of arm cylinder 28. Thus, mounting plate 80 extends through slot 40 and mounting plate 82 extends through slot 42. Each support bracket 92 has a surface 79, 81 which engages a top surface of the top plate 32 adjacent to a corresponding one of the slots 40, 42.

Thus, the boom 24 has a first end 23 adapted to be pivotally coupled to a first member or base 12, and has a second end 25 adapted to be pivotally coupled to a second member or arm 22. The mounting unit 39 is a transverse member which is fixed to and extends between a center portion of the side plates 36 and 38. Each of the boom cylinders 30 is a first hydraulic cylinder having a first end 31 coupled to the first member or base 12 and a second end or eye 68 or 70 coupled to the transverse member or mounting unit 39. Each cylinder mounting plate 80 and 82 is rigidly mounted to the transverse member or mounting unit 39 and projects away from the transverse member or mounting unit 39. The arm cylinder 28 is a second hydraulic cylinder having a first end 27 coupled to the mounting plates 80 and 82 and having a second end 29 coupled to the second member or arm 22.

The result is a boom in which loads from the arm cylinder 28 and the boom cylinders 30 are transmitted directly to the mounting unit 39 and not to the tope plate 32. The arm cylinder mounting plates 80 and 82 extend through slots 40 and 42 in the top plate 32 and they wrap around the tube 60 to create a more direct load path for arm cylinder loads. As a result, the top plate 32 can be made thinner and lighter, and the weight of the boom center section is reduced. This weight savings will also reduce the cost.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

We claim:

1. A boom assembly for a material handling machine, the boom assembly comprising:

a boom pivotally coupled to a frame of the machine, and having a pair of transversely spaced boom side plates, a top plate and a bottom plate that are rigidly interconnected, the top plate having a pair of slots spaced apart from each other;

an arm pivotally coupled to an end of the boom;

a mounting unit extending between a center portion of the side plates;

a pair of hydraulic boom cylinders, each boom cylinder having a first end coupled to the frame and a second end coupled to a respective end of the mounting unit;

a pair of arm cylinder mounting plates rigidly mounted to the mounting unit, the mounting plates being spaced apart from each other and projecting away from the mounting unit, each mounting plate extending through a corresponding one of the slots; and an hydraulic arm cylinder having a first end coupled to the mounting plates and having a second end coupled to the arm.

2. The boom assembly of claim 1, wherein, each mounting plate comprises:

a cylindrical ring which is fixed to and receives the mounting unit;

a base which is received by a corresponding one of the slots;

a pair of spaced apart support arms which attach the base to the ring; and a support bracket connected to and projecting from the base.

3. The boom assembly of claim 2, further comprising:

a pair of bores, each bore formed in one of the support brackets; and a cross pin having ends received by the bores.

4. The boom assembly of claim 3, wherein:

the arm cylinder is pivotally coupled to the cross pin.

5. The boom assembly of claim 2, further comprising:

each support bracket has a surface which engages a top surface of the top plate adjacent to a corresponding one of the slots.

6. The boom assembly of claim 1, wherein the mounting unit comprises:

a pair of hub members, each mounted to one of the side plates; and a hollow tube having opposite ends attached to the hub members.

7. The boom assembly of claim 6, wherein:

the hub members have central bores which extend therethrough; and a shaft is received by the central bores and extends through the hub members, the shaft having ends which are coupled to the boom cylinders.

8. A boom assembly for a material handling machine, the boom assembly comprising:

a boom pivotally coupled to a frame of the machine, and having a pair of transversely spaced boom side plates, a top plate and a bottom plate that are rigidly interconnected, the top plate having a pair of slots spaced apart from each other;

an arm pivotally coupled to an end of the boom;

a mounting unit extending between a center portion of the side plates;

a pair of hydraulic boom cylinders, each boom cylinder having a first end coupled to the frame and a second end coupled to a respective end of the mounting unit;

a pair of mounting plates rigidly mounted to the mounting unit, the mounting plates being spaced apart from each other and projecting away from the mounting unit, each mounting plate extending through a corresponding one of the slots, each mounting plate comprising a cylindrical ring which receives the mounting unit, a base which is received by a corresponding one of the slots, a pair of spaced apart support arms which attach the base to the ring, and a support bracket connected to the base;

a cross pin supported by the support brackets; and an hydraulic arm cylinder having a first end pivotally coupled to the cross pin and having a second end pivotally coupled to the arm.

9. A boom assembly for a material handling machine, the boom assembly comprising:

a boom having a pair of transversely spaced boom side plates that are rigidly interconnected, the boom having a first end adapted to be pivotally coupled to a first member, and having a second end adapted to be pivotally coupled to a second member;

a transverse member fixed to and extending between center portions of the side plates;

at least one first hydraulic cylinder having a first end coupled to the first member and a second end coupled to the transverse member;

a cylinder mounting plate rigidly mounted to the transverse member and projecting away from the transverse member, a second hydraulic cylinder having a first end coupled to the mounting plate and having a second end coupled to the second member, the boom including a top plate rigidly interconnected to the side plates, the top plate having a slot extending therethrough, and the mounting plate extending through the slot so that loads are transmitted from the second hydraulic cylinder directly to the transverse member bypassing the top plate.

* * * * *